US006574804B1

(12) United States Patent
Boujon

(10) Patent No.: US 6,574,804 B1
(45) Date of Patent: Jun. 10, 2003

(54) SAFETY AND LIFE-SAVING DEVICE FOR AQUATIC ENVIRONMENT

(76) Inventor: Claire-Lise Boujon, 33 rue de Montbrillant, Geneve (CH)

( * ) Notice: Subject to any disclaimer, the term of this patent is extended or adjusted under 35 U.S.C. 154(b) by 0 days.

(21) Appl. No.: 10/031,094

(22) PCT Filed: Dec. 21, 1999

(86) PCT No.: PCT/CH99/00619

§ 371 (c)(1),
(2), (4) Date: Jan. 9, 2002

(87) PCT Pub. No.: WO01/06076

PCT Pub. Date: Jan. 25, 2001

(30) Foreign Application Priority Data

Jul. 16, 1999 (CH) ..... 99/00327

(51) Int. Cl.[7] ..... E04H 4/00
(52) U.S. Cl. ..... 4/504; 4/498; 4/499
(58) Field of Search ..... 4/504, 498–99, 4/495, 501

(56) References Cited

U.S. PATENT DOCUMENTS 3,423,768 A * 1/1969 Glenn ..... 4/501
3,813,704 A * 6/1974 Troiano ..... 4/499
4,129,905 A 12/1978 Niemirow ..... 4/172.13
5,267,358 A * 12/1993 Roy et al. ..... 4/495
5,421,757 A 6/1995 Basiliere ..... 441/39
5,740,562 A * 4/1998 Nickalo ..... 4/496
5,832,547 A * 11/1998 Burroughs ..... 4/495
6,127,930 A * 10/2000 Steffanus ..... 340/539

FOREIGN PATENT DOCUMENTS

DE 32 10590 A1 10/1983 ..... B63C/9/16

OTHER PUBLICATIONS

International Search Report PCT/IPER Apr. 6, 2000.

* cited by examiner

*Primary Examiner*—Steven O. Douglas
*Assistant Examiner*—Amanda R. Flynn
(74) *Attorney, Agent, or Firm*—Abelman, Frayne & Schwab

(57) ABSTRACT

The invention concerns an inflatable grille, whereof the numerous openings are provided with open-worked netting, capable of being spaced apart and locked for rescuing in an aquatic environment someone stuck beneath the device to move onto the device and to clean the floor of a swimming pool more easily by inserting the vacuum cleaner in the netting openings which are capable of being spaced apart and locked. Said grille is associated with hoisting means adapted to the environment wherein it operates and in swimming pools with slide rails having a non-return system which blocks the device in high position.

31 Claims, 12 Drawing Sheets

SAFETY AND LIFE-SAVING DEVICE FOR AQUATIC ENVIRONMENT

The object of the present invention is to create rescue and safety devices which not only enable first aid to be given directly on the device but also, in open water, to enable a victim situated under the device to pass through the device, to come up and remain on top and, in a swimming pool, to be able to easily clean the bottom while walking on the device. This applies to Olympic pools, private swimming pools, lakes or open water, these devices supporting the weight of numerous persons moving about on the device.

The technical background discloses many submersible or non submersible covers or bottoms variable in steps, whose main function is not the rescue of persons in trouble. These devices are not reliable, notably in the case of submersible covers, as they are not sufficiently strong to support the weight of many persons and are moreover slow in their movement.

The document U.S. Pat. No. 4,129,905 of Dec. 19, 1978 has proposed to build a rescue device which is a net supported by an inflatable bladder of small size.

This device has the following drawbacks:

The arms and its periphery supporting the net has a diameter of 7.62 cm, the central bladder a diameter of 60 cm, the length of the pool is 6 m, the design features are not met for supporting the weight of the net and of a person. The bladder diameter of 60 cm is smaller than a conventional buoy.

The essential deficiency is that there is nothing to fix the device in a raised position.

Only two guide bars are provided at the deepest part of the pool with the sole purpose of guiding the flotation. According to the description by the inventor, guide bars are not necessary in the shallow part of the pool, which constitutes a real danger. Given the weakness of the device, if someone were recovered and brought up to the surface in the deepest part of the pool, the device would be drawn together on itself.

As is moreover acknowledged by the author, in order to ensure safety, the device must be covered with a tarpaulin when the pool is not being used, line 67 to 70, columns 2 and 3.

Patent application DE 32 10590 A1, 23.03.82 mentions a device for use in open water which has the following drawbacks:

The cells of the device are provided at certain places with empty spaces of 40 to 70 cm width which have been created to enable a person to pass through. This arrangement is dangerous in a rough sea, because a weakened person or child tossed about by the sea would be liable to pass under the device and be lost.

The structure of the air chambers of the floats has a diameter of 5 to 10 cm, commercially available individual life-buoys for bathing generally having a larger diameter and being intended for a calm sea.

The object of the invention is therefore to provide a rescue and safety device which is able to meet these deficiencies and drawbacks.

The advantages of the present invention reside in the fact that the openings in the netting are intended to enable cleaning the bottom of a swimming pool, it being easy in this case to reach the centre of the swimming pool by walking on the device to insert the arm of the vacuum cleaner and that, in the case of open water, the openings in the netting are intended to enable someone caught underneath the device to return to the surface by unlocking and widening the openings in the netting. The locking system prevents someone from sliding with ones weight into the slit. These openings with their locking system should be made visible by means of bright or fluorescent colours to indicate their presence.

Another advantage is that the device in swimming pools, lakes as well as a beach portion for example, comprises a system of guide rails with stops, which blocks the system in the high position, these stops balance the tension when several persons move about on the device. These stops also function to prevent the device from folding up under load, which prevents the device from forming a hollow between the edge of the swimming pool and the grille and prevents a child from slipping through between the device and the edge of the swimming pool.

The sheet, tarpaulin or the materials used to manufacture the grille may be woven or nonwoven synthetic or elastomer materials, but should be as light as possible and nevertheless be heavy enough for the deflated grille to sink down through its own weight, and to provide technical safeguards with regard to wear, tear, friction, pressure.

To this end, a person skilled in the art should know the maximum load which the device will have to support, taking into account the impact of weights projected onto the device, jumping, running, tension, pressure, friction to which the device is subjected, in order to be able to determine the diameter of the crosspieces of the grille, on which one should be able to walk easily, run, jump and play, and that with respect to the size of the openings, the dimension, number and strength of the slide rails and the stops, the criteria of strength of the netting, adapted in each case to the size of the water surface, Olympic pool or private swimming pool, with respect to the maximum load.

Another safety aspect has been allowed for due to the fact that the deflated grille placed at or near the bottom is connected to a vacuum pump in operating condition, connected to an alarm, whose purpose is to draw attention immediately to an infiltration of water into the device. This vacuum pump may also be used to help in deflating the grille.

The invention will be better understood on reading the description of the embodiments given as non-restrictive examples with regard to the underlying figures.

FIG. 1 shows a device composed of a non-inflated grille (1) which is not inflated here, lies on the bottom, is secured (2) to slide rails (3), whose tops are provided with a non-return system (4), here catches (13), for details see FIGS. 6*a, b, c*, 7*a* and *b*. Appearing transparently in the wall of the swimming pool is a compressed air cylinder (34) topped by a punch-button (35) and a coupling (32) with its release valve (41), the cylinder being connected to the grille by a pipe (36) with couplings (32) at both ends. One may also observe a netting (5) filling each mesh (39) of the grille, some of which are provided with an opening in the netting adapted to be widened and provided with locking means (6), the latter feature being applicable to any embodiment of the grille, in closed environments as well as in open water.

FIG. 2 shows the device in the high position composed of the inflated grille (1) with slide rails (3), netting (5) and netting openings (6) adapted to be widened or locked, whose mooring (2) rests on the non-return system (4), in this case the catches (13), for details see FIGS. 6*a*, 6*b*, 6*c* and 7*a* and *b*, blocking the device in the high position, with several persons moving about on the device, with a guard giving first aid on the device, a person running, others sitting, and another coming out by walking on the device.

FIG. 3 shows a variant of an embodiment of the structure of the inflatable grille (1) which is composed of an assembly of webs, impervious sheets joined together (7) and comprising openings which enable abundant passage of water, said openings being provided with netting (5), fastened to the grille by means of lugs (37) and fasteners (38), with openings (6) adapted to be widened, the whole being inflated with air or gas (8) which circulates between the webs, impervious joined sheets (7).

FIG. 4 shows another variant of an embodiment of the structure of the inflatable grille (1), whose meshes are assembled (9), while enabling the passage of air (8) inside the structure of the grille, netting (5) being provided in the meshes of the structure of the grille with openings (6) adapted to be widened.

FIG. 5 likewise shows another variant of an embodiment of the structure of the inflatable grille (1), which forms a network whose meshes are interlaced like netting allowing the passage of air (8) in the structure of the grille, and whose meshes are fitted with netting (5) with openings (6) adapted to be widened.

FIGS. 6*a*, 6*b*, 6*c* (section) show the inflated grille (1), a non-return system with a ring (10) and its fastener (30), the ring (10) surrounding a bar (11), with means for fastening to the wall (12), the ring sliding along the bar (11), and which on arriving at the high position pushes a catch (13) which swings on its axis (31) and falls back by its own weight, blocking the device in the high position.

FIGS. 7*a*, 7*b* (section) show the inflated grille (1) fastened to the wall (12) and an example of a non-return system with a slide (14) gliding inside a hollow slide rail (15), pushing on arrival in high position a catch (13), which falls back on a hinge stop (33), blocking the grille in the high position.

Figure 12A:
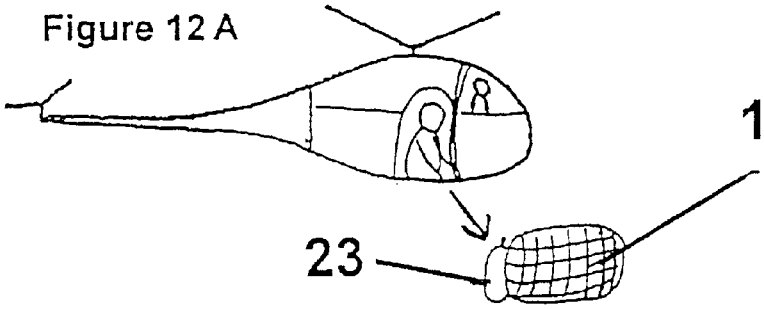

FIG. 12*a* shows the inflatable grille (1), folded up, with a foam/gas generator (23) dropped from an aircraft.

Figure 12B:
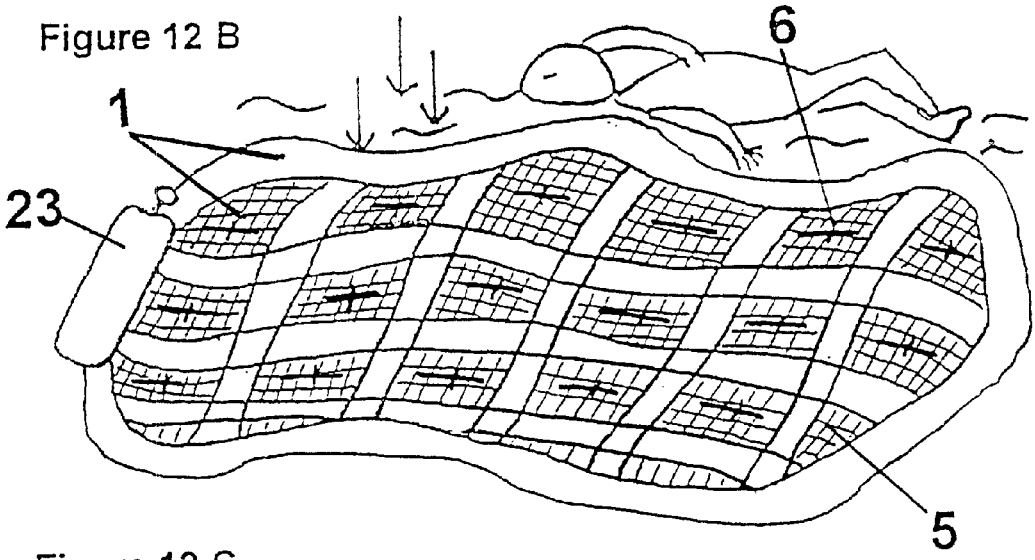

FIG. 12*b* shows the inflatable grille (1) spreading out in the water, with netting (5) in the meshes of the grille, an air/gas generator (23), and the openings adapted to be widened or locked (6).

Figure 12C:
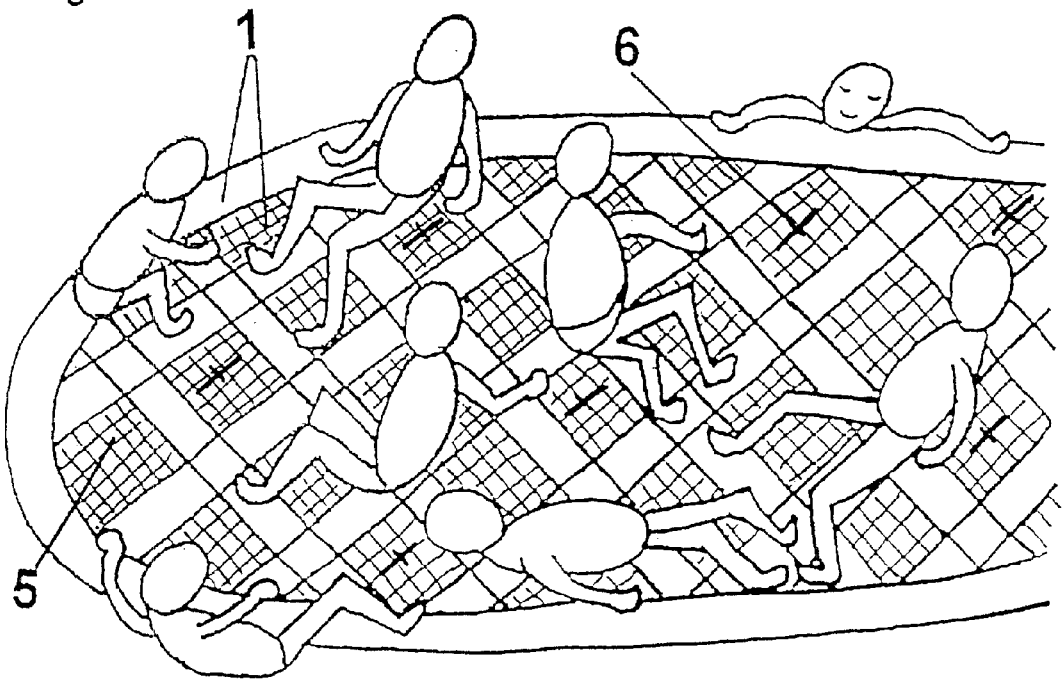

FIG. 12*c* shows the inflated grille (1), netting (5) in the meshes of the grille, openings adapted to be widened or locked (6) and supporting several persons in trouble.

Figure 13:
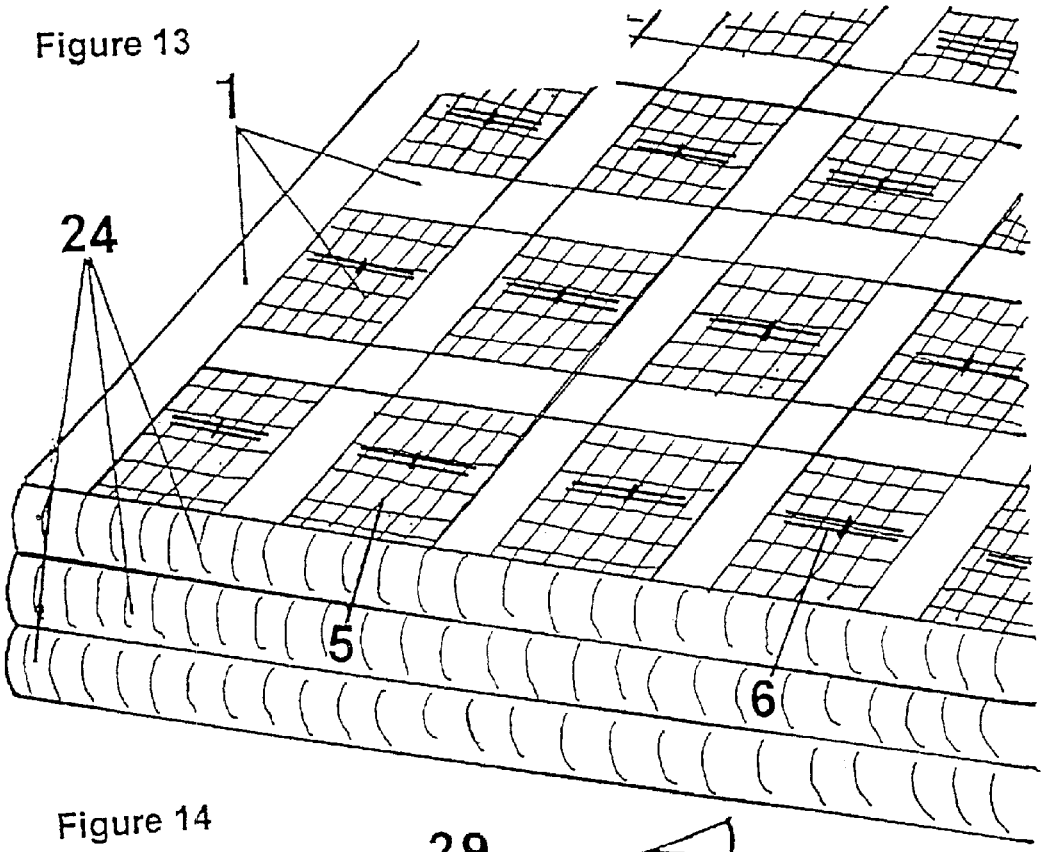

FIG. 13 shows the inflatable grille (1) with netting (5), openings adapted to be widened or locked (6), raised by means of superimposed ribs (24), whereby a distance is provided between the persons and the water.

Figure 14:
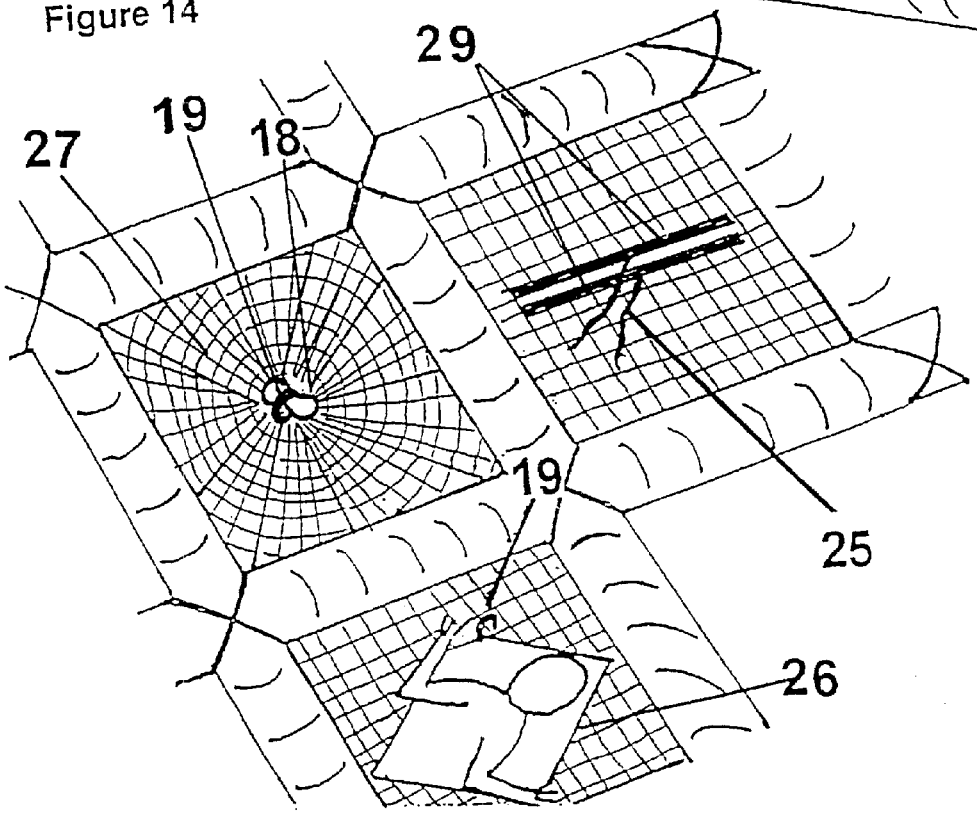

FIG. 14 shows three examples of openings adapted to be widened and clip fastened, here lips (29) reinforced with a resistant fabric and fasteners (25), spring rods (26) and a hook (19), radially arranged netting (27) with an elastic band (18) secured by means of a hook (19).

Figure 15:
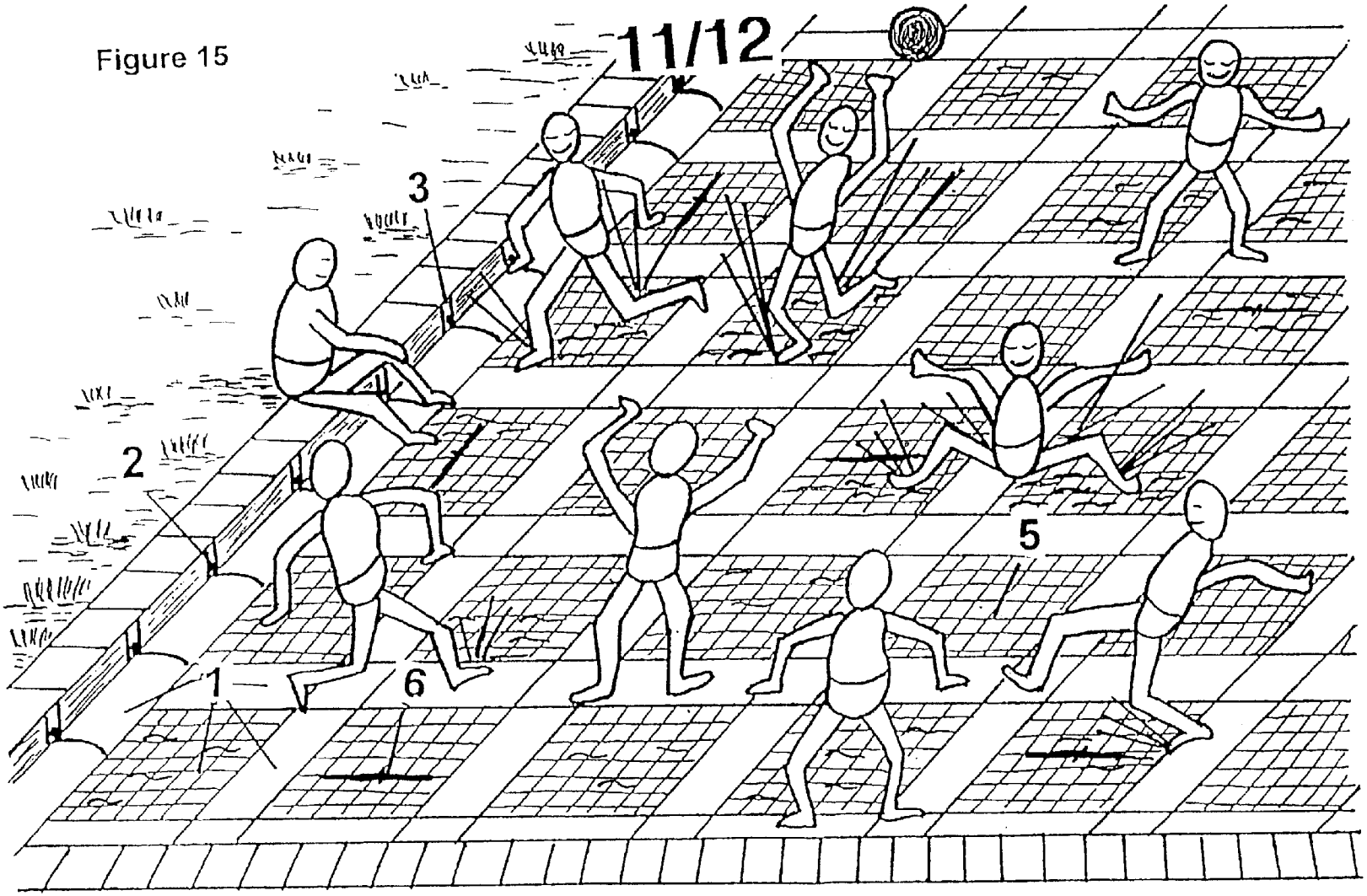

FIG. 15 shows the device, here the inflatable grille (1) secured (2) in high position to slide rails (3), netting (5) in the meshes of the grille, provided with openings adapted to be widened and secured (6), and with a team of bathers playing on the device.

Figure 16:
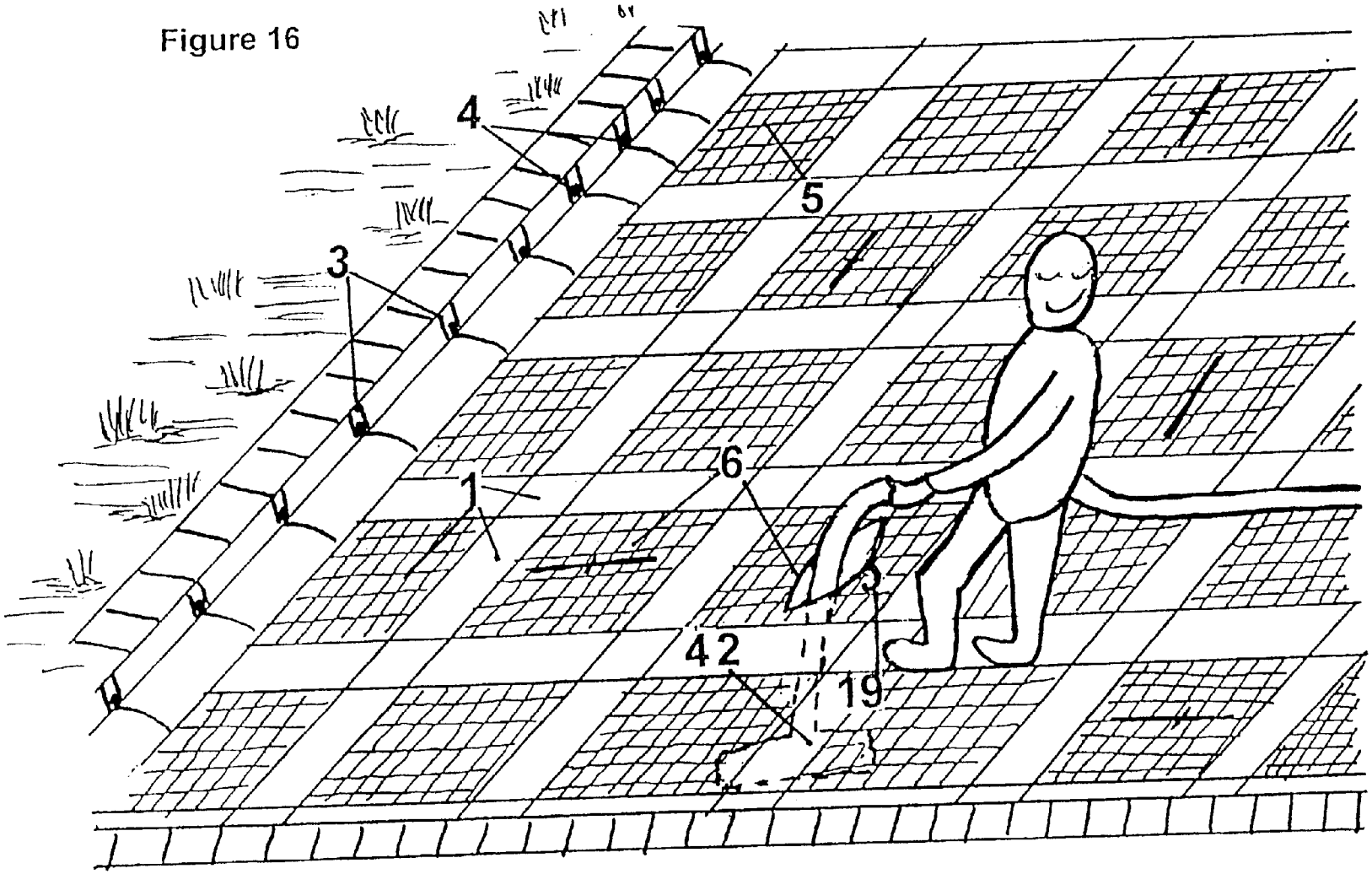

FIG. 16 shows the grille (1) in high position with its slide rails (3) and non-return system (4), netting (5), and someone vacuum cleaning while walking on the grille, the arm and the rotary broom (42) of the vacuum cleaner passing through the opening adapted to be locked and widened and provided with a locking hook (19).

Figure 1:
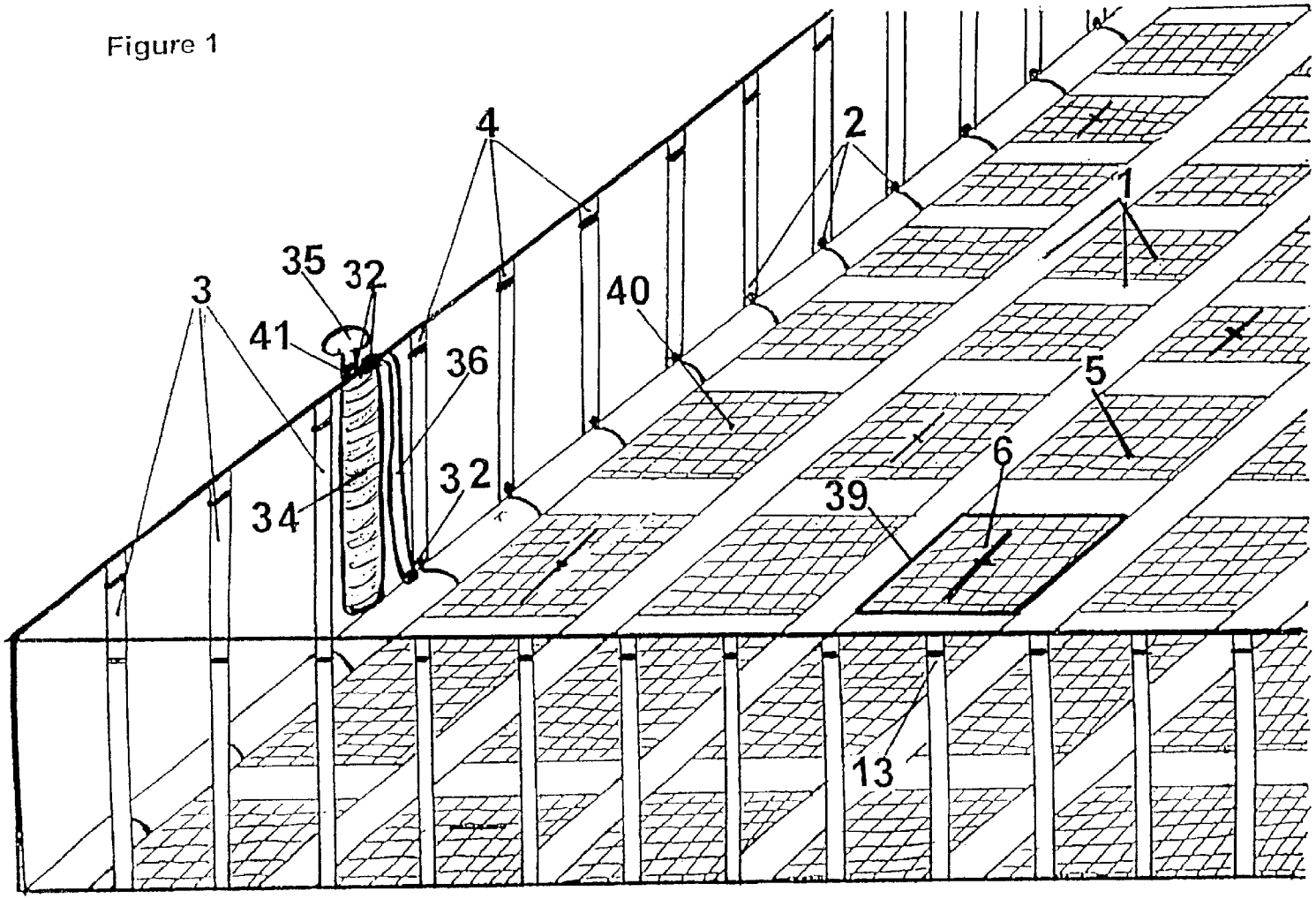
Figure 6A:
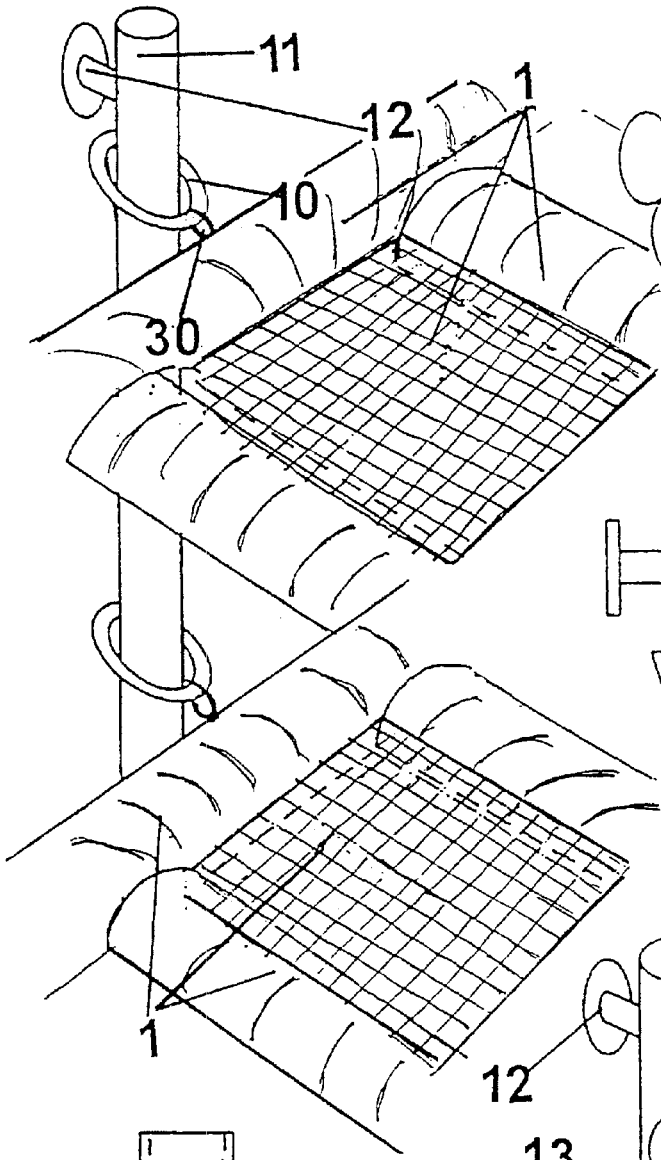
Figure 6B:
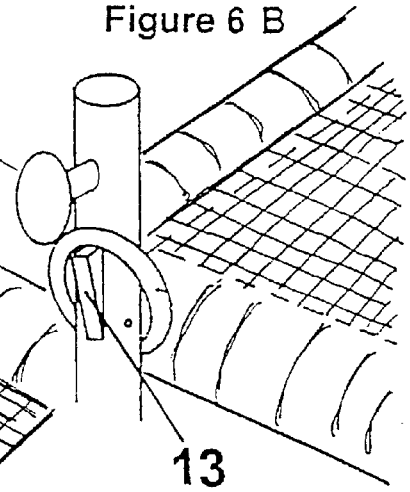
Figure 6C:
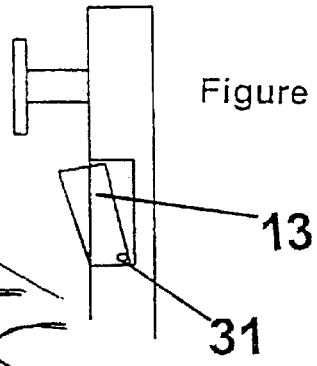
Figure 7A:
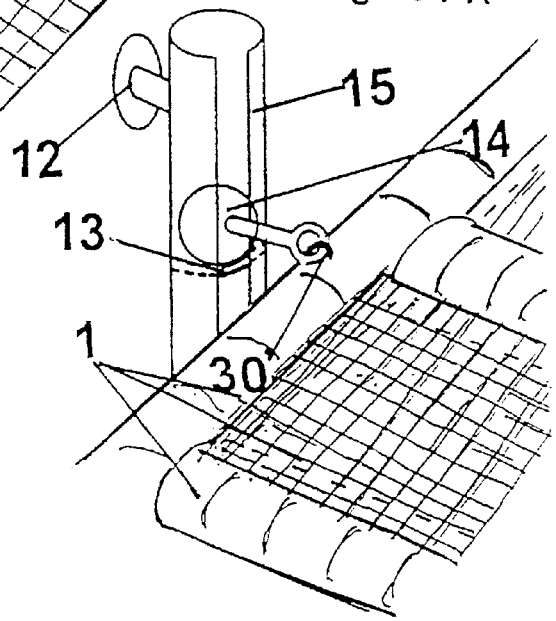
Figure 7B:
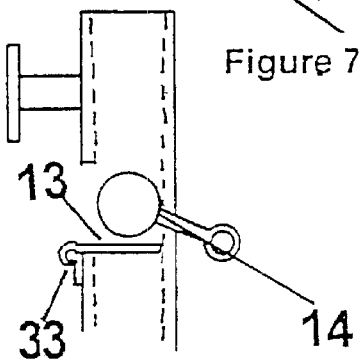

In a non-restrictive example of an embodiment intended for swimming pools or water surfaces such as portions of beaches, the present device is composed mainly of an inflatable grille (1), FIG. 1, whose meshes (39) are fitted with netting (5) which is provided with openings (6) adapted to be widened or locked; said grille (1) is not inflated, rests upon the bottom (40) and is secured to the slide rails (3) by means of a slide (14) and its fastener (30) to the grille, see this detail in FIGS. 7*a* and 7*b*, said slide rails (3) are provided with a non-return system (4), FIG. 1, see detail FIGS. 6*a, b, c* and 7*a* and 7*b*; the grille with this design is connected by means of a pipe (36) and couplings at both ends (32), FIG. 1, to a compressed air cylinder (34) or to a gas generator, on which is fixed by means of the coupling (32) a punch button (35) or handle, push-button, and a release valve (41), FIG. 1. The device thus designed rises to the surface by means of air or gas driven therein and is blocked in the high position thanks to the non-return system of the slide rails, see FIG. 2. It is adaptable to swimming pools, Olympic pools, water surfaces, beaches and may serve as a playground.

For large swimming pools or Olympic pools, it is possible to constitute the device in sections interconnected by means of netting, which prevents someone from passing under the device when one section is inflated and an adjacent section is not, while bathers move about on the device. It is recommended in that case to arrange a punch-button or handle and cylinder on each of the opposite sides of the section or at each end of the swimming pool, so as not to have to run around the swimming pool to be able to operate the device.

It is also possible to conceive several pipes with couplings to the grille grouped in multiple branches with couplings to the cylinder, this allowing air/gas to arrive at several points in the grille; the same applies to the punch-buttons, handles, push buttons connected by means of pipes, branches, couplings and valve(s).

It is also possible to facilitate the distribution of inflation by inserting into the grille structure a pipe pierced along its entire length, this possibility being applicable to any type of embodiment of the grille.

The grille folded up is dropped from a boat or aircraft, without the slide rails, with its openings adapted to be widened or locked, pairs of toe clips, toe clips with extensions, and with an automatic inflating system, and when unfolded it covers a large surface and serves for lifesaving in open water.

For water surfaces such as portions of beaches, the slide rails will be securely fastened at the bottom and thus define the safety or playing zone.

One thus has here neither a submersiblecover, nor a bottom which is raised, but rather a safety and rescue grille which may serve as a playground.

There are numerous locking systems for the openings in the netting, and a few non-restrictive examples are given here:

A slit closed by means of a Velcro fastener with broad bands.

Two spring rods (26) protected by a sheathing which may be fixed by a hook (19), FIG. 14.

Figure 9:
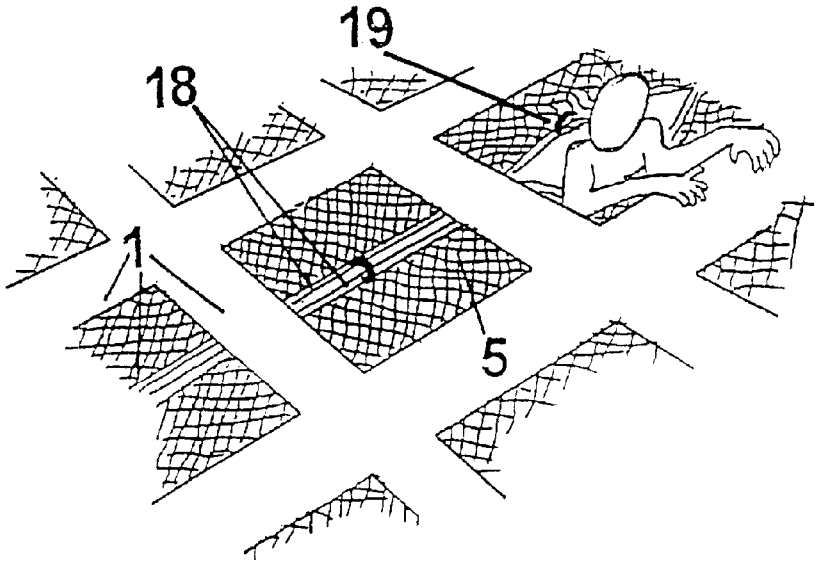
FIG. 9 shows the inflated grille (1), with netting (5) in the meshes of the grille and an opening system with elastic bands (18) provided with a hook (19) to ensure closing.

The slit in the netting may be bordered with two elastic bands (18) which maintain it closed with a hook (19), FIG. 9.

Lips reinforced with a band of resistant fabric, or synthetic fabric or elastomer (29), stitched, glued or welded and fasteners (25), FIG. 14.

These non-restrictive examples of openings adapted to be widened or locked are suitable for swimming pools as well as for open water, whereas the two following examples seem more suitable for the device in open water, this not being restrictive.

The hooks (19), FIG. 9, may be simple ones or such clips as in safety belts, or release devices (28), FIG. 10, or they may be lengthened with a handle (22), FIG. 11, situated below and flush with the netting which, when pulled downwards, releases the hook integral therewith, and frees the opening.

Figure 8:
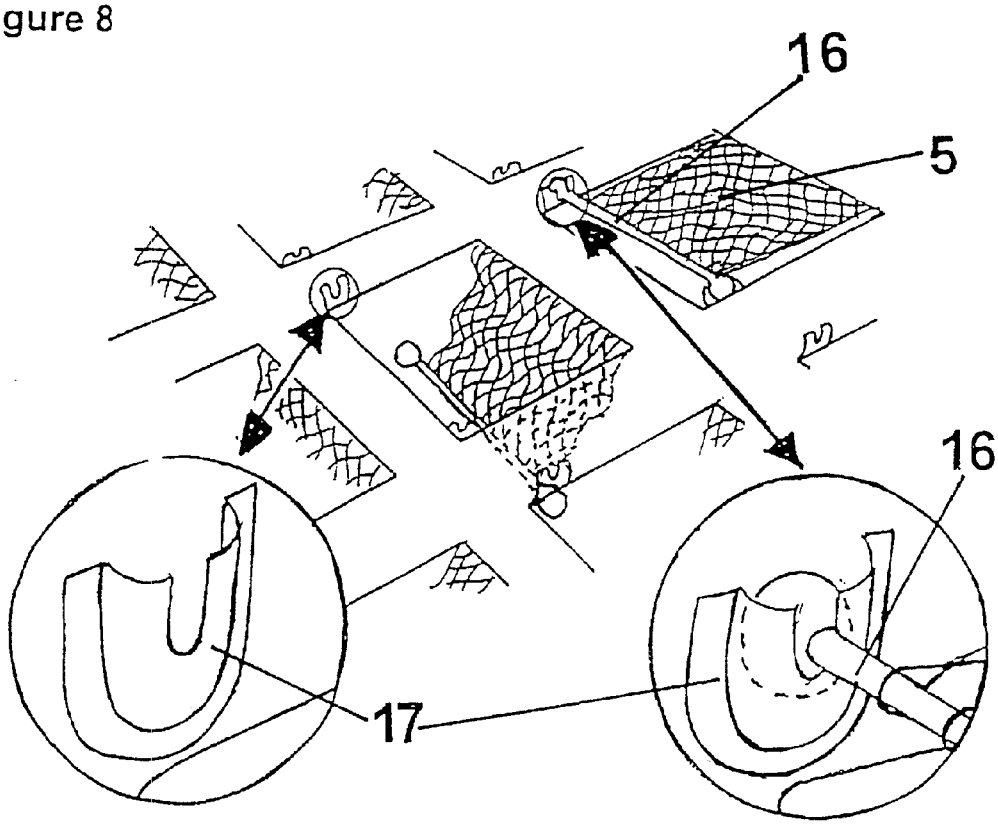
FIG. 8 shows a system for opening the netting (5) hanging to a bar (16) provided with two balls which come to engage in slotted receiving cups (17).

Netting fixed on one side of the mesh of the grille structure, with the other side comprising a bar provided with a fastening system, such as balls (16), FIG. 8, hooks, rings, spring hooks at its ends which fit in a support for the ball, in a ring for the hook, in a hook for the ring, and so on. Instead of the bar for securing the netting, it may be secured solely with a hooking system, or a series of catches, but the bar may at the same time secure the netting in at least two points.

The netting may be radially arranged (27), tied up in the middle with an elastic band (18), both sides of the circle brought together and secured with a hook (19), FIG. 14.

Concerning the distribution of the netting openings adapted to be widened or locked, in open water it seems desirable to provide one in each mesh of the grille, but this is not imperative and it is possible to provide a smaller number. In swimming pools, the openings adapted to be widened or locked could be scattered over the device, the arm of the vacuum cleaner covering a certain surface, but it may nevertheless be more convenient to provide each mesh of the grille with one opening adapted to be widened or locked.

As for the slide rails, there are countless non-return systems, such as stops, racks, ratchet gear, wedge rings, split wedges, a catch either with or without a slit, resting on a tappet, or not, the grille coming up to the surface slides along the hollow slide rails driving a slide which arrives at the top of the slide rail, pushes the catch, the fastener of the slide is then engaged in the slot of the catch or in the case of a simple catch (13), FIG. 7*a*, the slide (14), while coming up along the hollow slide rails (15), will come to lie on the catch as indicated in FIG. 7*b*, in both cases the grille will be blocked in the high position.

Another version of the non-return slide rail could be a bar (11), a vertical ramp with a ring (10) fastened to the grille by means of a link (30) and surrounding the bar (11), the ring (10) sliding upwards due to the thrust of the grille, and which, when arriving at the top of the bar, falls back onto a catch attached thereto and which swings on its axis (31) and returns to its place by its own weight. The catch may also come to abut against a spring which returns it to its initial position.

These non-return systems are simple to unlock once the grille is deflated, one only has to raise the slide by hand by pulling it and causing it to pass under the catch; for the ring, one has to push the catch on its axis and the ring falls back, the deflated grille can descend once more.

This choice of non-return systems is not restrictive. The size and thickness of the catches and the tappets will be defined as a function of the diameter of the slide rails, their number and the load and tension which they have to support.

One can multiply the systems along the slide rails or guide bars so that the system will hook on anywhere on the path, whether the swimming pool is full or not, one can thus create a rack and safety is ensured under any circumstances.

In open water the air/gas may be replaced with a driven closed-cell foam which is developed inside the device, this particularity being of special interest because it makes the device unsinkable. A person skilled in the art will have to find the foam which is best adapted to this feature of the invention.

It should be noted that, in closed environments, the grille is situated at or in the vicinity of the bottom in the low position and that in open water it is situated at a certain depth determined by its weight and its impact when dropped and goes back to the surface when it is inflated by appropriate means.

If the inflatable grille is to be laid down at the water surface, rather than dropped, its inflation could be set off on contact with the water by means of chemical valves, or else manually by means of handles, release systems, retarded releases, these examples not being restrictive.

Figure 10:
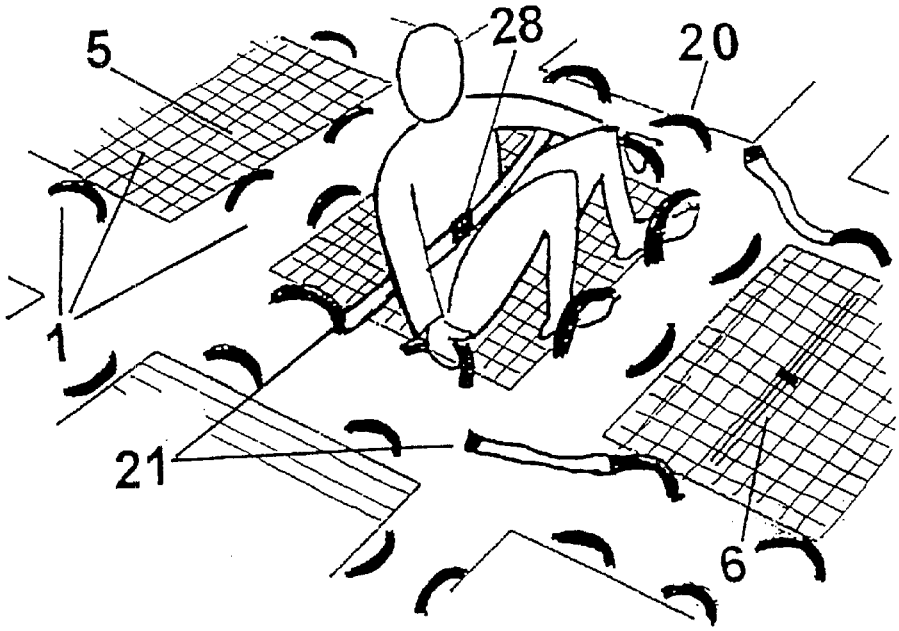
FIG. 10 shows the inflated grille (1), an opening (6) adapted to be widened or locked, netting (5) and with a person sitting in a mesh of the grille, with the feet slipped into toe clips (20) and the hands taking hold of the toe clips as handles, toe clips lengthened with a strap (21), provided with a clip fastener (28) serving as a safety belt.
Figure 11:
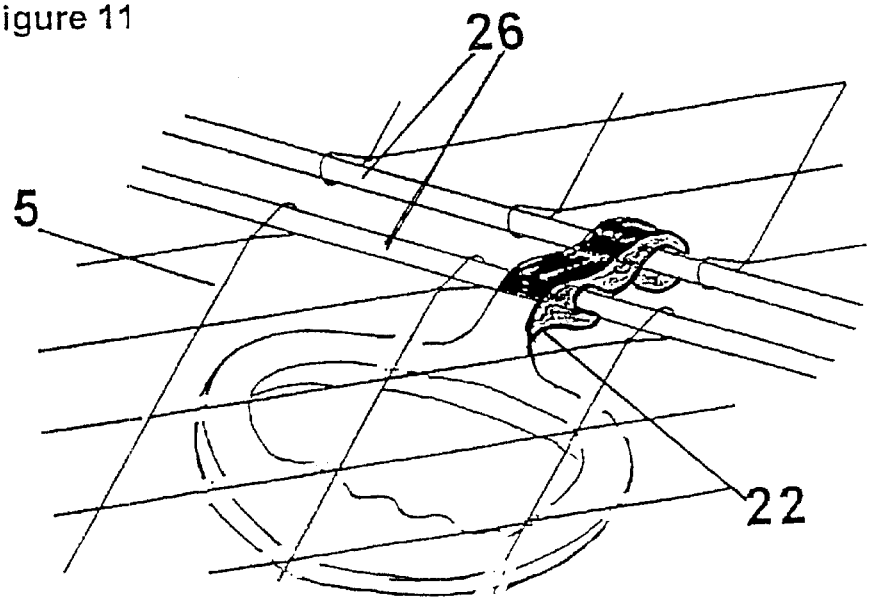
FIG. 11 shows the netting (5) with an example of a closure of an opening adapted to be widened, with spring rods (26) closed by means of a hook which is lengthened with a handle (22) situated under the netting which releases the opening of the netting when it is pulled downwards.

In open water, the grille is provided with pairs of adjustable or non-adjustable toe clips 20, FIG. 10, enabling someone sitting in the netting or on a crosspiece to reach the opposite pair of toe clips, with or without folding the legs, to slip the feet into them, to point them to the sky, to slip in the hands, forearms into those which are at his sides and to thus keep himself in place on the device in case of a rough sea; if he capsizes, he is not tied to the device and can pass through the openings adapted to be widened and unlocked.

Now, if preferred, when certain toe clips are lengthened with an adjustable strap and provided with clip fasteners, as in safety belts or releases (21), FIG. 10, one may catch one on the left and one on the right, clip them together and thus form a safety belt, or else may choose to use them to attach equipment to the device.

In the variant notably for use in open water, one may envisage that the grille, especially for a small vessel or aircraft, is deflated by means of stops of the type used in pneumatic mattresses or by withdrawing a simple stop, screwed on or not, or the rescue team on board the aircraft or boats will have a vacuum pump for use to help deflating the grille.

Figure 3:
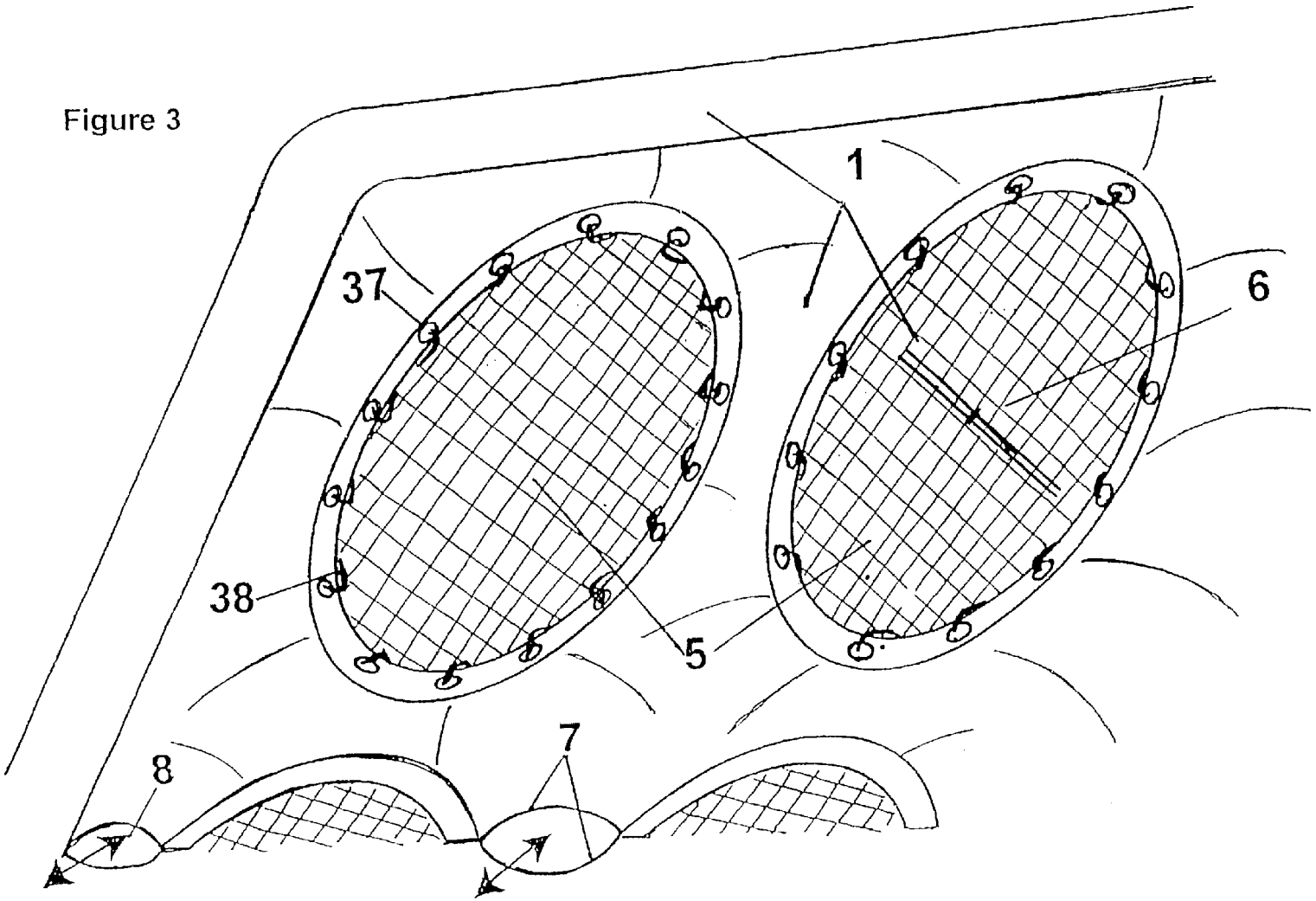
Figure 4:
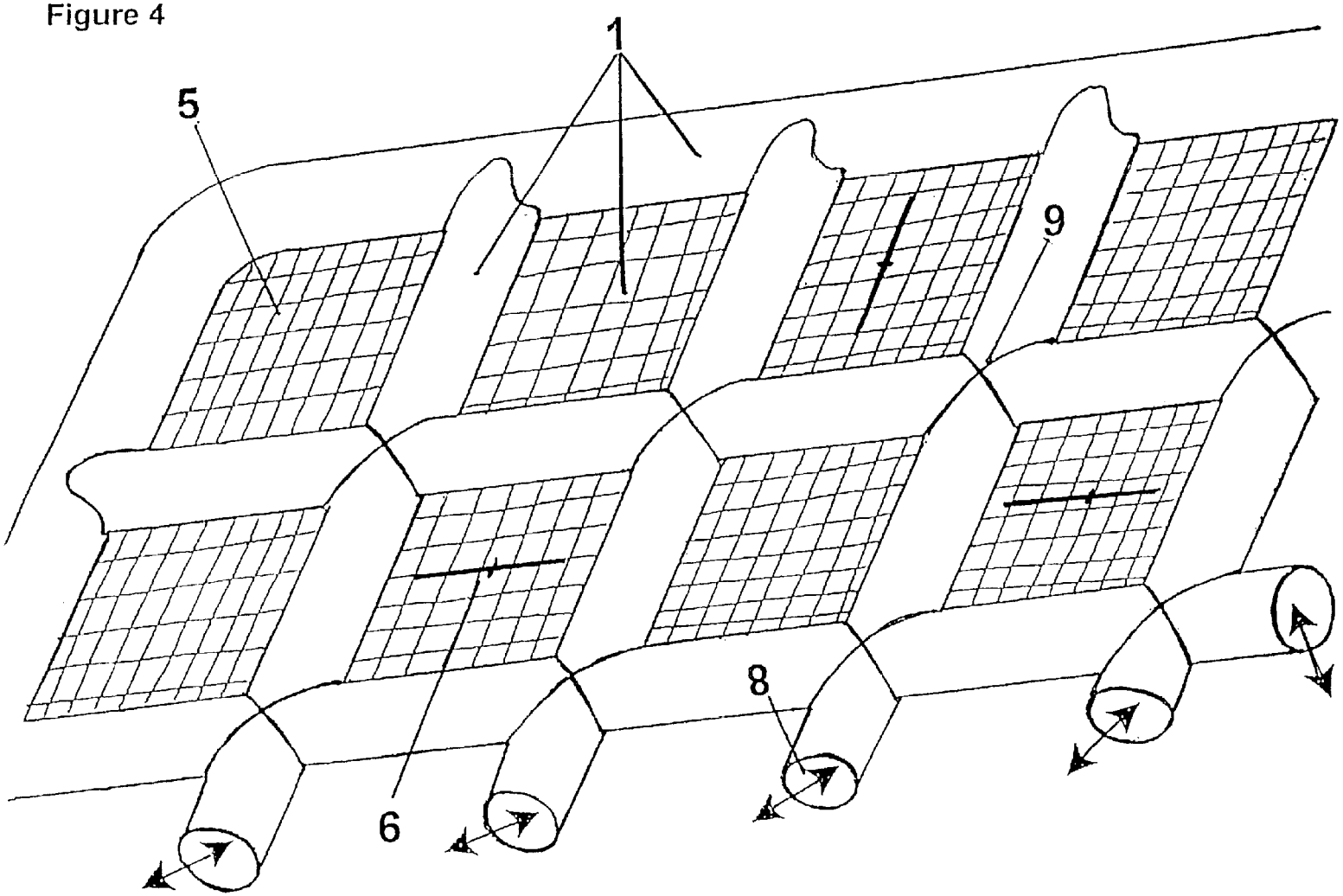
Figure 5:
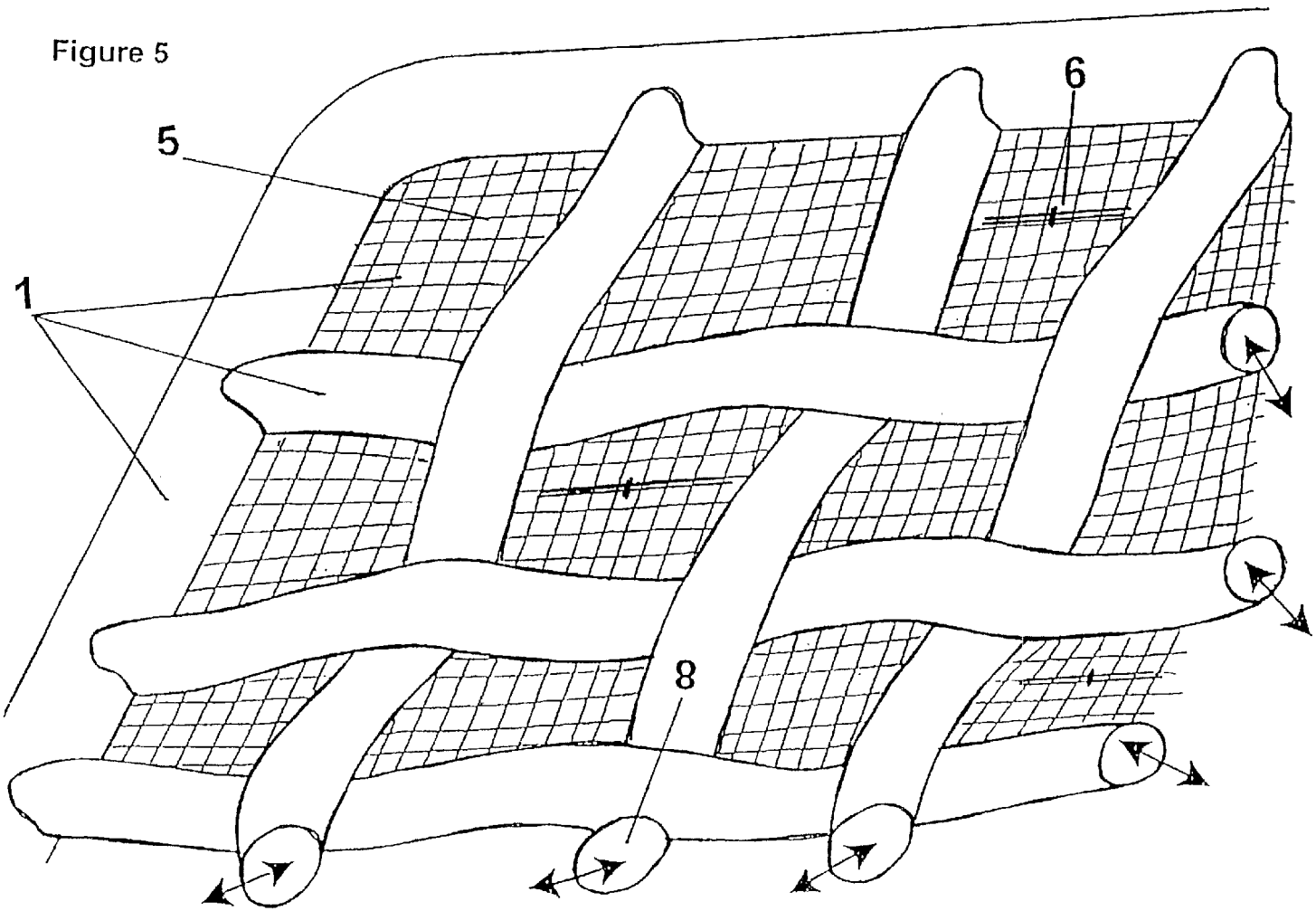

The netting in the meshes of the grille could be bonded, welded, sewn, moulded, fastened by means of lugs (37), FIG. 3, and the same applies to the toe clips, which are padded or unpadded straps fastened at both ends to the crosspieces of the grille, this not being restrictive. The netting may be fixed at any desired height inside the mesh of the grille.

It should be noted that the inflatable grille for use in open water may be made entirely or partly fluorescent, it may be coated or covered with metallic products or carry metallic elements enabling it to be located by radar, may be provided with radio-wave transmitters, acoustic transmitters, survival kits, emergency beacons enabling it to be located. For swimming pools or water surfaces, presence detectors may be installed and distributed around the water surface and vice-versa and connected to an alarm in order to indicate a fall.

Once the grille is inflated it resembles a large game board on which one may jump in balance from crosspiece to crosspiece, or run on the crosspieces, or with several persons in the netting, with a slight trampoline effect, whose vibrations are dampened by the non-return system of the slide rails, FIG. 15, and may thus serve as a playground.

In a swimming pool, the device in high position enables cleaning the bottom, FIG. 16.

Figure 2:
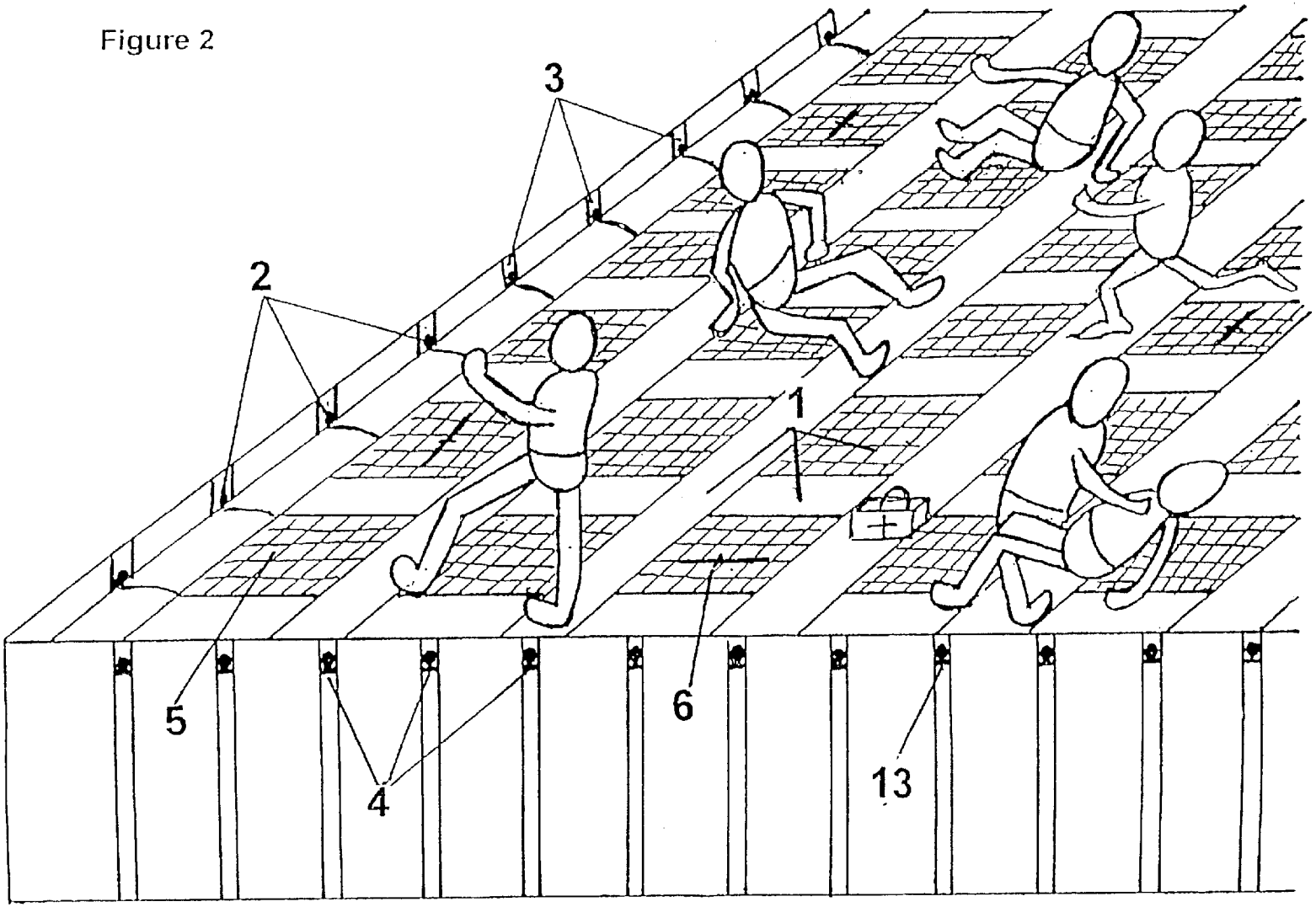

The device has a certain advantage that a guard may easily come to the assistance of a person in trouble and administer first-aid directly on the device, whereby precious time is gained, and that it is possible to make the person in trouble lie down on the back and be settled more comfortably than on the border of a swimming pool, FIG. 2.

This grille is placed at the bottom to attend to the safety of the bathers, its mooring becomes active in the high position when it is blocked in the non-return system of the slide rails, it ensures the rescue of persons in trouble by coming up to the surface; in the high position, it ensures the safety of the environment while, in open water, it enables many persons to take refuge on a large surface.

In open water, the size of the grille may be adapted to the size of the boat or to the number of persons which the device has to support. As it takes little space, one may envisage arranging more than one per boat; it should be kept protected from any infiltration of water in a cover, sheath, or waterproof case which may be easily opened, with a simple and rapid unlocking system for example. The grille may finally be formed of superimposed ribs which set a distance between the water and the persons on the device.

These grilles may be folded up and stored separately on board ships, cargo boats or any other vessels as well as on board any type of aircraft. They enable persons on a jetty for example, to use a distress toboggan to descend on the device, while the device may be connected or not to the toboggan by means of a system of fasteners which may be easily released.

When the swimming pool is not in use, the device may be placed in the high position and covered with a protective covering enabling the passage of water, fastened to the top of the guide rails, in order to prevent small impurities or dead leaves from soiling the swimming pool water.

What is claimed is:

1. A rescue and safety apparatus for receiving personnel in aquatic environments comprising:

an inflatable grille structure formed by one or more peripheral members defining an enclosed area and a plurality of internal members extending between the one or more peripheral members to thereby define a plurality of regularly-spaced open regions within the enclosed area, the peripheral and internal members being tubular and formed from a flexible, collapsible watertight material;

a flexible open-mesh netting extending over the open regions and secured to at least one of the one or more peripheral members and the internal members, said netting being provided with at least one resealable access opening that is located at an open region between the adjacent members; and manually-releasable locking means attached to the netting adjacent the at least one access opening for securely joining the opposing sides of the access opening in a closed position.

2. The apparatus of claim 1, wherein at least a portion of the one or more peripheral members are joined to the one or more internal members in internal fluid communication.

3. The apparatus of claim 1, wherein the plurality of internal members intersect and are joined in internal fluid communication.

4. The apparatus of claim 1, wherein the open regions are selected from shapes selected from the group consisting of rectilinear, quadralinear, polygonal, curvilinear and combinations thereof.

5. The apparatus of claim 1, wherein the upper surface of at least a portion of the peripheral and internal members is configured to stably receive walking, seated and/or supine personnel.

6. The apparatus of claim 1, wherein the plurality of internal members intersect each other in alternatingly overlying relationship.

7. The apparatus of claim 1, wherein the cross-section of the peripheral and internal members is selected from the group consisting of round, oval, curvilinear, rectilinear and combinations thereof.

8. The apparatus of claim 1, wherein the at least one access opening is dimensioned to freely pass adult personnel from below the netting to the upper surface of the apparatus.

9. The apparatus of claim 1, wherein the at least one access opening is dimensioned to freely pass a portion of pool cleaning and maintenance apparatus.

10. The apparatus of claim 1 which further comprises a container of an inflation medium in controlled fluid communication with the peripheral and internal members, whereby release of the inflation medium inflates the grille structure to render it buoyant in the aquatic environment.

11. The apparatus of claim 1 which further comprises:

a vacuum pump in fluid communication with the interior of the grille;

a power source for the vacuum pump; and a water-sensing alarm system operatively connected to the vacuum pump, whereby water leaking into the interior of the grille will be drawn into contact with the alarm sensor to thereby indicate the leak.

12. The apparatus of claim 1, wherein there are at least two peripheral members in superposed vertical arrangement, whereby the netting is supported above the water's surface.

13. The apparatus of claim 12, wherein at least one separate auxiliary fluid conduit is positioned internally and extends between the tubular members that are in fluid communication.

14. The apparatus of claim 13, wherein the auxiliary fluid conduit is perforated piping, whereby distribution of the inflation medium throughout the grille is facilitated.

15. The apparatus of claim 1, wherein the one or more peripheral members and the plurality of internal members extend to form a substantially planar contiguous upper surface.

16. The apparatus of claim 15, wherein the open regions are curvilinear.

17. The apparatus of claim 1 further comprising a plurality of personnel restraining devices secured to the upper surface of the plurality of internal members.

18. The apparatus of claim 17, wherein the personnel restraining devices include loops for receiving the limbs of personnel positioned on the apparatus.

19. The apparatus of claim 18, wherein the personnel restraining devices include releasable belts for passing around the torso of personnel on the upper surface of the apparatus.

20. The apparatus of claim 1, wherein the netting is attached to one of the peripheral or internal members at a first end of the open region and is secured to the locking means at a second free end opposite the first end.

21. The apparatus of claim 20, wherein the locking means comprises:

an elongated rod to which the free end of the netting is secured, the rod terminating in flanged ends; and corresponding slotted retainers secured to the peripheral or internal members for receiving the flanged ends;

whereby access is gained by removing the flanged ends of the rod from the retainers and moving the netting out of the open region.

22. The apparatus of claim 1, wherein the locking means comprises at least one hook having a first end secured to the netting on one side of the opening and a second open end for engaging and releasably retaining the opposite side of the opening in the netting.

23. The apparatus of claim 22, wherein the second open end of the hook is formed with a resilient member.

24. The apparatus of claim 23, wherein the hook is formed with a handgrip to thereby facilitate the release of the open end of the hook from the opposing sides of the access opening.

25. The apparatus of claim 24, wherein the opposing sides of the access opening in the netting are provided with spring rods, the rods being engaged by the at least one hook.

26. The apparatus of claim 1, wherein the locking means comprises at least one pair of hook-and-loop fastener strips attached, respectively, to opposite sites of the access opening.

27. The apparatus of claim 26, wherein the inflation medium is selected from the group consisting of compressed gas and an expandable polymeric closed-cell foam composition.

28. The apparatus of claim 26 in the form of a compact, air-droppable assembly that further includes a water-sensitive actuator, whereby the inflation medium is released into the grille structure upon contact with water.

29. The apparatus of claim 26, wherein the controller for the inflation medium is selected from the group consisting of manually-actuated ball valves, push-button valves, electronically-controlled valves responsive to manually initiated signals and electronic sensor-generated signals.

30. The apparatus of claim 1, wherein the surface of the one or more peripheral members further comprise external fastening means for engaging external restraining means, whereby the apparatus is restrained from horizontal movement in the aquatic environment.

31. The apparatus of claim 30, wherein the external fastening means is selected from the group consisting of rings, loops formed of rigid and flexible materials, and ball and rod slides.

* * * * *